US006162136A

United States Patent [19]

Aoyama

[11] Patent Number: 6,162,136

[45] Date of Patent: Dec. 19, 2000

[54] GOLF BALL DIMPLE

[75] Inventor: Steven Aoyama, Marion, Mass.

[73] Assignee: Acushnet Company, Fairhaven, Mass.

[21] Appl. No.: 09/208,455

[22] Filed: Dec. 10, 1998

[51] Int. Cl.[7] ..... A63B 37/14

[52] U.S. Cl. ..... 473/383; 473/384

[58] Field of Search ..... 473/383, 384, 473/378

[56] References Cited

U.S. PATENT DOCUMENTS

| | | | |
|---|---|---|---|
| D. 319,481 | 8/1991 | Shaw . | |
| D. 355,943 | 2/1995 | Cadorniga . | |
| 922,773 | 5/1909 | Kempshall . | |
| 1,666,699 | 4/1928 | Hagen . | |
| 1,681,167 | 8/1928 | Beldam | 473/383 |
| 1,716,435 | 6/1929 | Fotheringham . | |
| 2,135,210 | 11/1938 | Farrar | 473/383 |
| 4,787,638 | 11/1988 | Kobayashi | 473/383 |
| 5,377,989 | 1/1995 | Machin | 473/383 |
| 5,470,076 | 11/1995 | Cadorniga . | |
| 5,536,013 | 7/1996 | Pocklington . | |
| 5,735,757 | 4/1998 | Moriyama | 473/384 |
| 5,957,787 | 9/1999 | Hwang | 473/379 |

FOREIGN PATENT DOCUMENTS

| | | |
|---|---|---|
| 9620-45 | 5/1932 | Canada . |
| 8464 | 6/1911 | United Kingdom . |
| 297368 | 10/1928 | United Kingdom . |
| 315575 | 8/1929 | United Kingdom . |
| 2 103 939 | 3/1983 | United Kingdom . |
| 2 215 621 | 9/1989 | United Kingdom . |

OTHER PUBLICATIONS

Olman et al., *Golf Antiques & Other Treasures of The Game*, 1992, cover page and p. 95, p. 96, and p. 99.

*Primary Examiner*—Sebastiano Passaniti
*Assistant Examiner*—Raeann Gorden
*Attorney, Agent, or Firm*—Pennie & Edmonds LLP

[57] ABSTRACT

In accordance with the present invention, a golf ball includes an outer surface and a plurality of dimples formed thereon. At least one of the dimples is a concentric ring dimple. Each concentric ring dimple includes a central depression, and at least one annular depression that concentrically surrounds the central depression. A land ring extends between the central depression and the annular depression. When the concentric ring dimple includes additional annular depressions, land rings extend between the adjacent annular depressions. The concentric ring dimples provide additional dimple circumference over conventional dimples that occupy the same space, thereby improving the aerodynamic performance of the golf ball.

24 Claims, 7 Drawing Sheets

GOLF BALL DIMPLE

TECHNICAL FIELD OF THE INVENTION

The present invention generally relates to golf balls, and more particularly, to a golf ball having improved types of dimples.

BACKGROUND OF THE INVENTION

Golf balls generally include a spherical outer surface with a plurality of dimples formed thereon. Conventional dimples are circular depressions that act to reduce drag and increase lift. These dimples are formed where a dimple wall slopes away from the outer surface of the ball forming the depression. The circumference of each dimple is the edge formed sphere the dimple wall slopes away from the outer surface.

Drag is the air resistance that acts on the golf ball in the direction opposite the ball's flight direction. As the ball travels through the air, the air that surrounds the ball has different velocities thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the air flow that results from the ball's backspin. Due to the backspin, the top of the ball moves with the airflow, which delays the air separation point to a location further backward. Conversely, the bottom of the ball moves against the air flow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is critical in optimizing this flow phenomenon, as well.

By using dimples to decrease drag and increase lift, almost every golf ball manufacturer has increased their golf ball flight distances. In order to optimize ball performance, it is desirable to have a large number of dimples, hence a large amount of dimple circumference, which is evenly distributed around the ball. In arranging the dimples, an attempt is made to minimize the space between dimples, because such space does not improve aerodynamic performance of the ball. In practical terms, this usually translates into 300 to 500 circular dimples with a conventional sized dimple having a diameter that ranges from about 0.120 inches to about 0.180 inches. "Small" dimples in this application mean those with a diameter less than about 0.120 inches, and "large" dimples mean those with a diameter greater than about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness. On the other hand, a smaller number of large dimples also begin to lose effectiveness. This results from the circumference of one large dimple being less than that of a group of smaller dimples.

U.K. Patent No. 2 215 621 discloses a dimple for use in a uniform distribution over the spherical, outer surface of a golf ball so that the dimple pattern has an overall, identical configuration irrespective of the direction of motion of the ball. In one embodiment, at least one dimple has a circular cavity surrounded by an annular cavity. The radial distance between the circular cavity and the annular cavity is described as up to 0.039 inches (1.0 mm). A radial distance this large is undesirable, since it means a large amount of the golf ball's outer surface is not covered by aerodynamically effective dimples. One embodiment, as shown in FIG. 7 of this patent, describes the annular cavity as of small dimensions and configuration relative to the circular cavity and shows the radial distance as larger than the width of the annular cavity. The reference discloses that the width of the annular cavity is between 0.0039 inches (0.1 mm) and 0.079 inches (2 mm).

Most balls today have dimple patterns with many spaces between dimples or have filled in the spaces with large dimples or groupings of small dimples that do not create the optimal aerodynamic effect at average golf ball velocities. It is desirable to provide a type of dimple that increases aerodynamic effectiveness and either fills spaces in the dimple pattern or replaces small or large dimples used in the past.

SUMMARY OF THE INVENTION

In accordance with the present invention, a golf ball includes an outer surface and a plurality of dimples formed thereon and at least one of the dimples is a concentric ring dimple. Each concentric ring dimple includes a central depression that has a central depression diameter, and at least one annular depression that concentrically surrounds the central depression. The annular depression has an annular depression width. A land ring extends between the central depression and the annular depression that has a land ring width. When the concentric ring dimple includes additional annular depressions, land rings extend between the adjacent annular depressions.

In one embodiment, the land ring width is substantially less than the annular depression width. In another embodiment, the annular depression width is substantially less than the central depression diameter. In yet another embodiment, a golf ball includes at least two types of dimples. The first type of dimple is a concentric ring dimple, and the second type of dimple is a circular depression.

Although the concentric ring dimples are larger than conventional dimples, the annular depressions add to the dimple circumference so that concentric ring dimples improve the aerodynamic performance of the golf balls.

DETAILED DESCRIPTION OF THE PREFERRED EMBODIMENT

Figure 1:
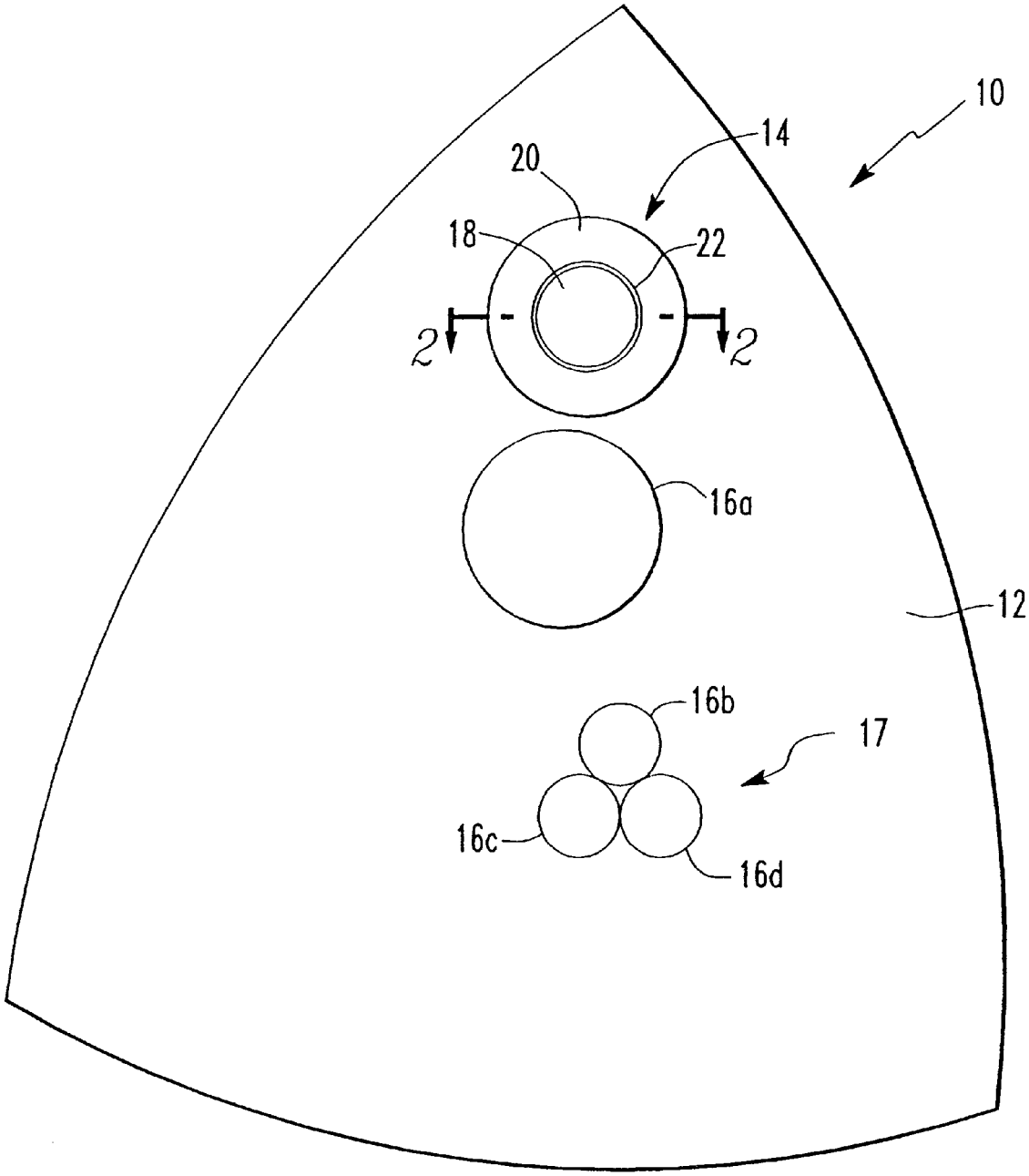
FIG. 1 is a schematic view of a portion of a first embodiment of a golf ball having conventional dimples and a first embodiment of a dimple of the present invention.

Referring to FIG. 1, a portion of a golf ball 10 includes a spherical outer surface 12 that has two types of dimples 14 and 16*a–d* formed thereon. The first type of dimple 14 is a single-ring dimple in accordance with the present invention. The second type of dimples 16*a–d* are conventional dimples that are circular depressions. The dimple 16*a* is a large dimple. The dimples 16*b–d* are a group 17 of adjacent small dimples.

Referring to FIG. 1, the dimple 14 includes a central depression 18, an annular depression 20 that concentrically surrounds the central depression 18, and a land ring 22 there between.

Figure 2:
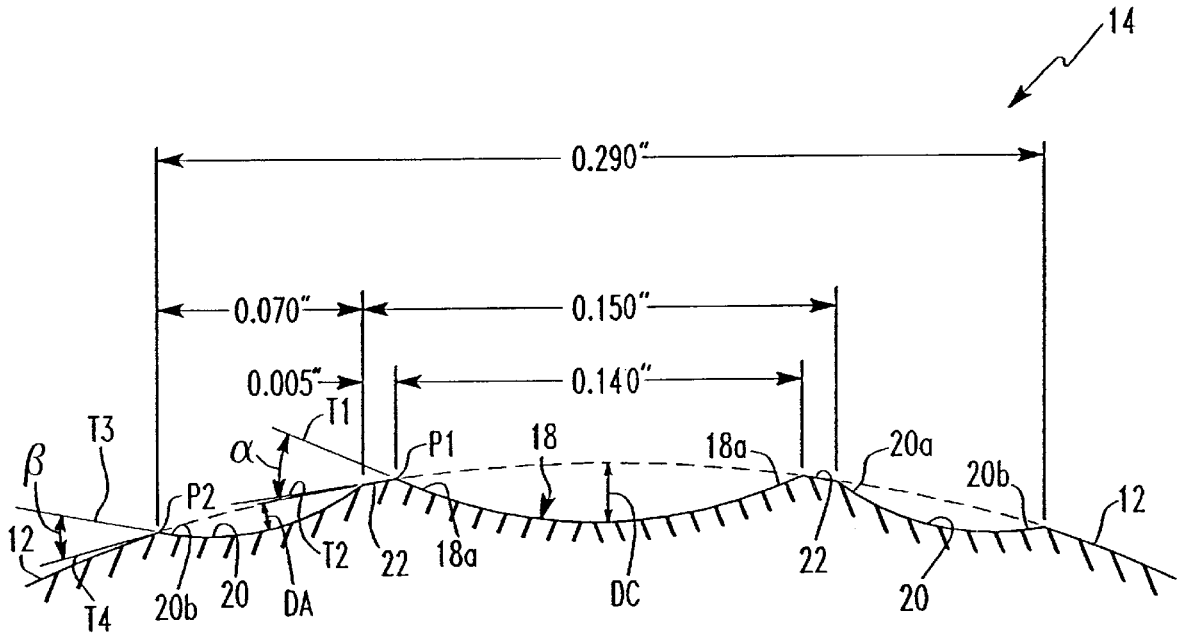
FIG. 2 is an enlarged, cross-sectional view of the first embodiment of the dimple of the present invention along line 2—2 of FIG. 1.

Referring to FIGS. 1 and 2, the central depression 18 includes a circular cross-section and an annular wall 18*a*. The annular wall 18*a* is adjacent to the land ring 22. The annular depression 20 has a circular cross-section, an annular inner wall 20*a* adjacent the land ring 22, and an annular outer wall 20*b* adjacent the outer surface 12 of the ball.

The land ring 22 extends between the central depression 18 and the annular depression 20. The land ring 22 helps make up a portion of the outer surface 12 of the golf ball 10. Typically the term "land" means the area of the outer surface of the ball not covered with dimples which is the outer surface of the ball between dimples. Thus, the term land ring means the area of the outer surface not covered with dimples that forms an annulus between the depression 18 and an annular depression 20 or between adjacent annular depressions.

Each depression further includes an edge angle. The central depression 18 has an edge angle α measured at a point P1. The point P1 is located where the dimple wall 18*a* diverges from the land ring 22. A first line tangent to the dimple wall 18*a* at point P1 is designated by the letter T1. A second line tangent to the land ring 22 at the point P1 is designated by the letter T2. The edge angle α is the angle between the tangent lines T1 and T2. The edge angle α is preferably between about 10° and about 25°. The most preferred edge angle α is about 16°.

The annular depression 20 has an outer edge angle β measured at a point P2. The point P2 is located where the outer wall 20*b* diverges from the outer surface 12 of the ball. A third line tangent to the dimple wall 20*b* at point P2 is designated by the letter T3. A fourth line tangent to the outer surface 12 at the point P2 is designated by the letter T4. The edge angle β is the angle between the tangent lines T3 and T4. The edge angle β is preferably between about 10° and about 25°. The most preferred edge angle β is about 16°. An inner edge angle with respect to the inner wall 20*a* of the annular depression 20 is defined similarly to the outer edge angle β and preferably has the same dimension. It is preferred that the edge angles for the central depression 18 and the annular depression 20 are approximately equal and uniform about the circumference of each depression.

Referring to FIG. 2, the diameter of the central depression 18 is about 0.140 inches. The inner diameter of the annular depression 20 is about 0.150 inches. The outer diameter of the annular depression 20 is about 0.290 inches, which corresponds to the total diameter of the dimple 14. The width of the annular depression 20 is about 0.07 inches. The land ring width 22 is less than about 0.01 inches and preferably about 0.005 inches. Thus, the land ring width is substantially less than the annular depression width. The land ring width is less than about 14% of the annular depression width, and more preferably between about 7% and about 10% of the annular depression width. The annular depression width is about 50% of the central depression diameter.

It is preferred that the land ring width is as small as possible, so that the outer surface area of the ball without dimples is minimized. This will allow the maximum dimple circumference, which will optimize the ball's aerodynamic performance. The need to decrease the outer surface area by narrowing the land ring is balanced against durability concerns. As the land ring width decreases, the susceptibility of the land ring to wear by impact with the golf club increases.

Furthermore, the single-ring dimples 14 are sized so that the central depression 18 and annular depression 20 are not subject to paint flooding. Therefore, they are large enough to be aerodynamically effective. The diameter of these dimples is fixed by the dimple layout on the entire golf ball 10.

The central depression has a depth DC that is a radial distance measured from the center of the depression to the phantom line representing the outer surface 12 of the ball. The annular depression has a depth DA that is a radial distance measured from the center of the annular depression to the phantom line representing the outer surface 12 of the ball. The depth of the depressions is set by the edge angle and the diameter or width of the depression. The central depression depth DC is substantially greater than or equal to the annular depression depth DA. In one embodiment, the central depression depth is more than twice the annular depression depth.

Referring to FIG. 1, the conventional dimples 16*a* and/or 16*b–d* are disposed on the golf ball surface 12. These dimples can be distributed in a conventional pattern, for example one based on an icosahedron. A single-ring dimple 14 can be distributed on the golf ball outer surface 12 to fill in empty areas in the dimple pattern between the conventional dimples 16*a–d* or to replace one large dimple 16*a* or one group 17 of adjacent small dimples 16*b–d*. It is preferred that the single-ring dimple 14 is used to replace one large dimple 16*a* or one group 17 of adjacent small dimples 16*b–d*. In another embodiment, all of the dimples are single-ring dimples. In yet another embodiment, between about 3% and about 50% of the dimples are single-ring dimples 14, and the remaining dimples are dimples 16*a–d*. In still another embodiment, less than about 25% of the dimples are single-ring dimples 14, and the remaining dimples are dimples 16*a–d*.

Figure 3:
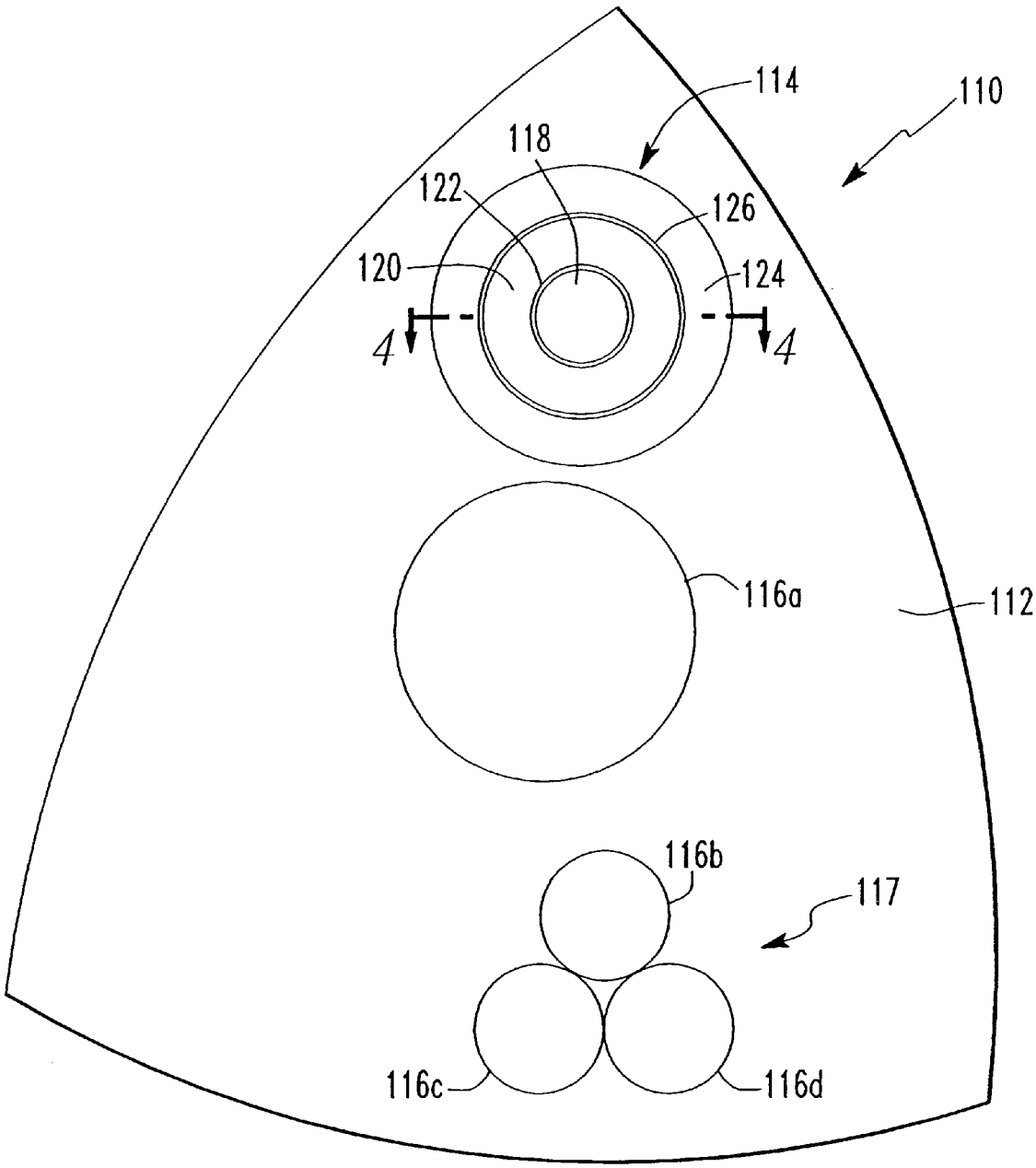
FIG. 3 is a schematic view of a portion of a second embodiment of a golf ball having conventional dimples, and a second embodiment of the dimple of the present invention.

Referring to FIG. 3, a modified golf ball 110 is illustrated. The components of the golf ball 10 that are similar to the components of the ball 10 (as shown in FIG. 1) are represented by the same number proceeded by the numeral "1." The golf ball 110 has a spherical outer surface 112 that includes two types of dimples 114 and 116*a–d* formed thereon. The first type of dimple 114 is a double-ring dimple in accordance with the present invention. The second type of dimples 116*a–d* are conventional dimples that are circular depressions. The dimple 116*a* is a large dimple. The dimples 116*b–d* are a group 117 of adjacent small dimples.

Referring to FIG. 3, the double-ring dimple 114 includes a central depression 118, a first annular depression 120 concentrically surrounding the central depression 118, a first land ring 122 there between, a second annular depression 124 that concentrically surrounds the first annular depression 120, and a second land ring 126 between the first annular depression 120 and the second annular depression 124.

Figure 4:
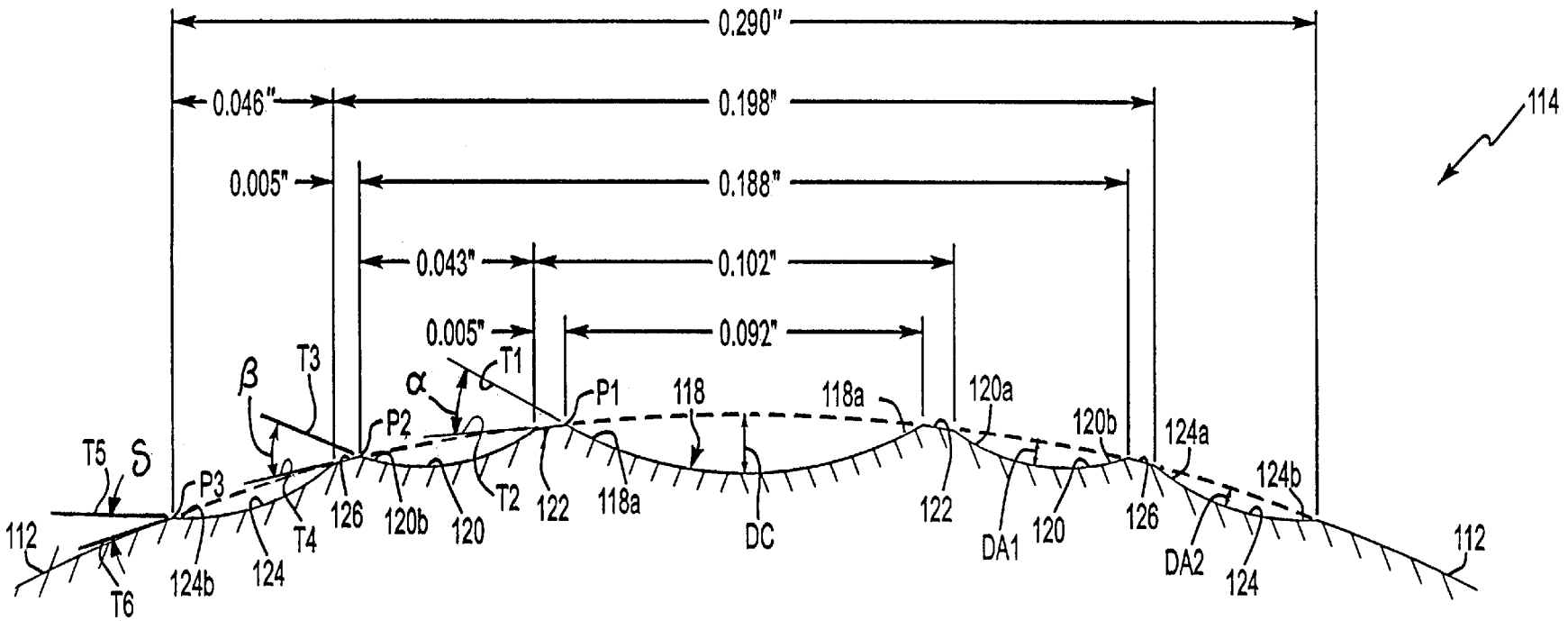
FIG. 4 is an enlarged, cross-sectional view of the second embodiment of the dimple of the present invention along line 4—4 of FIG. 3.

Referring to FIGS. 3 and 4, the central depression 118 includes a circular cross-section and an annular wall 118*a*. The annular wall 118*a* is adjacent to the first land ring 122. The first annular depression 120 includes a circular cross-section, an annular inner wall 120*a* adjacent the first land ring 122, and an annular outer wall 120*b* adjacent the second land ring 126.

The first land ring 122 extends between the central depression 118 and the first annular depression 120. The first land ring 122 makes up a portion of the outer surface 112 of the golf ball 110.

The second annular depression 124 includes a circular cross-section, an annular inner wall 124*a* adjacent the second land ring 126, and an annular outer wall 124*b* adjacent the outer surface 112.

The second land ring 126 extends between the first annular depression 120 and the second annular depression 124. The second land ring 126 makes up a portion of the outer surface 112 of the golf ball 110.

Each depression further includes an edge angle. The central depression 118 has an edge angle $\alpha$ measured at a point P1. The point P1 is located where the dimple wall 118*a* diverges from the first land ring 122. A first line tangent to the dimple wall 118*a* at point P1 is designated by the letter T1. A second line tangent to the first land ring 122 at the point P1 is designated by the letter T2. The edge angle $\alpha$ is the angle between the tangent lines T1 and T2. The edge angle $\alpha$ is preferably between about 10° and about 25°. The most preferred edge angle $\alpha$ is about 16°.

The first annular depression 120 has an outer edge angle $\beta$ measured at a point P2. The point P2 is located where the outer wall 120*b* diverges from the second land ring 126 of the ball. A third line tangent to the dimple wall 120*b* at point P2 is designated by the letter T3. A fourth line tangent to the second land ring 126 at the point P2 is designated by the letter 14. The edge angle $\beta$ is the angle between the tangent lines T3 and T4. The edge angle $\beta$ is preferably between about 10° and about 25°. The most preferred edge angle $\beta$ is about 16°. An inner edge angle with respect to the inner wall 120*a* of the first annular depression 120 is defined similarly to the outer edge angle $\beta$, and preferably has the same dimension.

The second annular depression 124 has an outer edge angle $\delta$ measure at a point P3. The point P3 is located where the outer wall 124*b* diverges from the outer surface 112 of the ball. A fifth line tangent to the dimple wall 124*b* at the point P3 is designated by the letter T5. A sixth line tangent to the outer surface 112 at the point P3 is designated by the letter T6. The edge angle $\delta$ is the angle between the tangent lines T5 and T6. The edge angle $\delta$ is preferably between about 10° and about 25°. The most preferred edge angle $\delta$ is about 16°. An inner edge angle with respect to the inner wall 124*a* of the second annular depression 124 is defined similarly to the outer edge angle $\delta$, and preferably has the same dimension. It is preferred that the edge angles for the central depression 118, the first annular depression 120, and the second annular depression 124 are approximately equal and uniform about the circumference of each depression.

Referring to FIG. 4, the diameter of the central depression 118 is about 0.092 inches. The inner diameter of the first annular depression 120 is about 0.102 inches. The outer diameter of the first annular depression 120 is about 0.188 inches. The width of the first annular depression 120 is about 0.043 inches. The width of the first land ring 122 is about 0.005 inches. The first land ring width is substantially less than the first annular depression width. The first land ring width is less than about 12% of the first annular depression width, and more preferably about 11% of the first annular depression width.

The inner diameter of the second annular depression 124 is about 0.198 inches. The outer diameter of the second annular depression 124 is about 0.290 inches, which corresponds to the total diameter of the dimple 114. The width of the second annular depression 124 is about 0.046 inches. The width of the second land ring 126 is about 0.005 inches. The second land ring width is substantially less than the second annular depression width. The second land ring width is less than about 12% of the second annular depression width, and more preferably about 11% of the second annular depression width. The width of the first and second annular depressions 120 and 124 are substantially equal. Each of the annular depression widths is about 50% of the central depression diameter.

The double-ring dimple 114 is sized so that the central depression 118 and the annular depressions 120 and 124 are not subject to paint flooding. Therefore, they are large enough to be aerodynamically effective. The diameter of each dimple is fixed by the dimple layout on the entire golf ball 110.

The central depression has a depth DC that is a radial distance measured from the center of the depression to the phantom line of the outer surface 12 of the ball. The first annular depression has a depth DA1 that is a radial distance measured from the center of the first annular depression to the phantom line of the outer surface 12 of the ball. The second annular depression has a depth DA2 that is a radial distance measured from the center of the second annular depression to the phantom line of the outer surface 12 of the ball. The depth of the depressions is set by the edge angle and the diameter or width of the depression. The central depression depth DC is substantially greater than or equal to the depth of the annular depressions DA1 and DA2. In one embodiment, the central depression depth is more than twice the annular depression depths.

Figure 5:
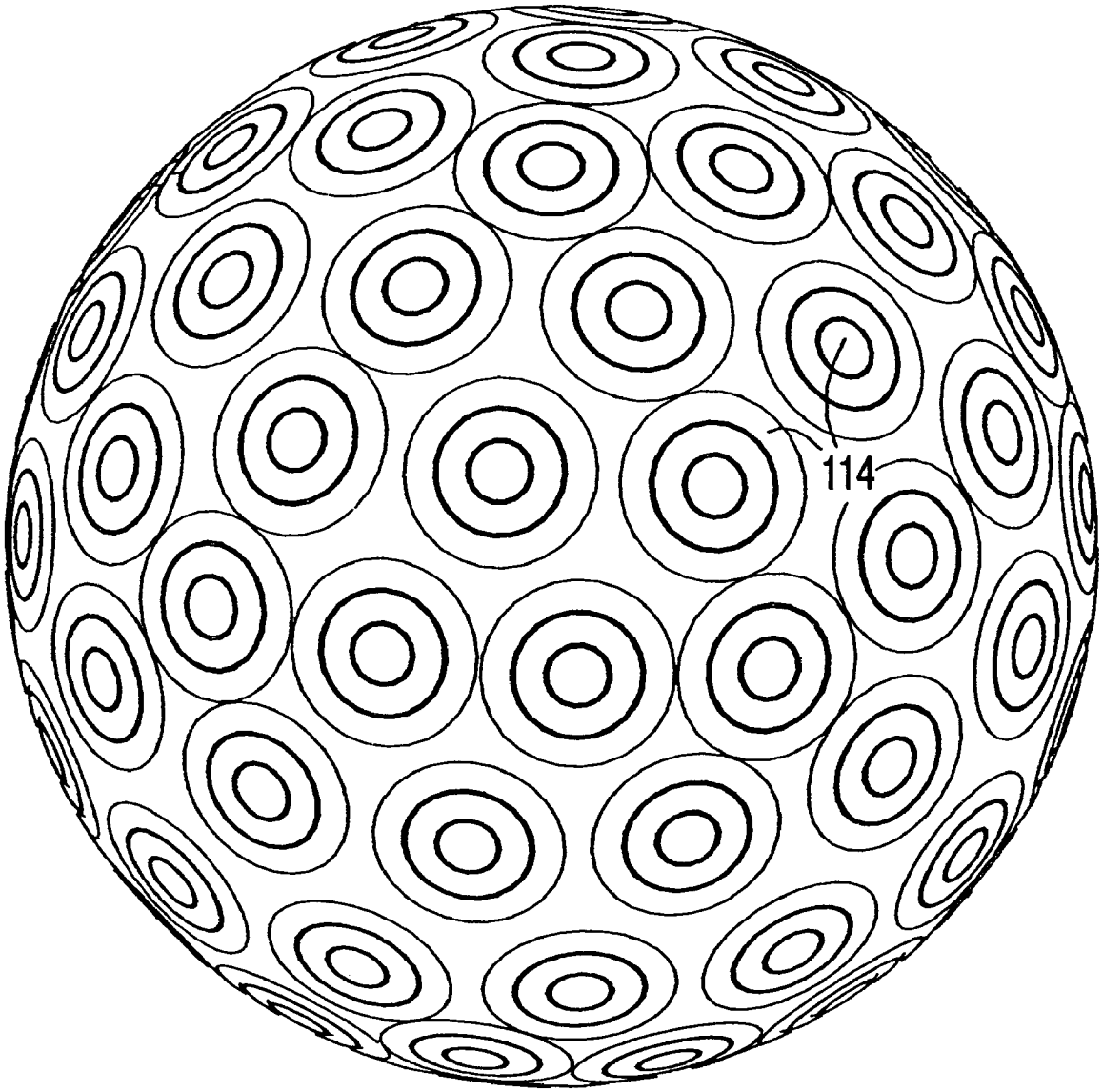
FIG. 5 is a perspective view of a third embodiment of a golf ball having dimples according to the present invention.

Referring to FIG. 3, conventional dimples 116*a* and/or 116*b–d* are disposed on the golf ball surface 112. These dimples can be distributed in a conventional pattern, for example one based on an icosahedron. The double-ring dimples 114 can be distributed on the golf ball outer surface 112 to fill in empty areas in the dimple pattern between the dimples 116*a–d*. It is preferred that the double-ring dimple 114 is used to replace one large dimple 116*a* or one group 117 of adjacent small dimples 116*b–d*. In one embodiment, between about 3% and about 50% of the dimples are double-ring dimples 114, and the remaining dimples are conventional dimples 116*a–d*. In another embodiment, less than about 25% of the dimples are double-ring dimples 114, and the remaining dimples are conventional dimples 116*a–d*. As shown in FIG. 5, the double-ring dimples 114 are used in a uniform dimple pattern.

Other embodiments of the golf ball may include conventional dimples, single-ring dimples, and double-ring dimples in a variety of combinations depending on the aerodynamic performance desired. The conventional dimples can be distributed on the golf ball surface in a conventional pattern, for example in an icosahedron. The conventional dimples can be small, large, or average (i.e., those having a diameter between 0.120 inches and 0.180 inches). The single-ring dimples and the double-ring dimples are distributed on the golf ball outer surface to fill in empty areas in the dimple pattern between the conventional dimples, or to replace groups of adjacent small conventional dimples or one large conventional dimple. In one embodiment, between about 3% and about 50% of the dimples are single and double-ring dimples combined, and the remaining dimples are conventional dimples. The concentric ring dimples can be used with conventional large dimples and/or small dimples. In another embodiment, less than 25% of the dimples are single-ring and double-ring dimples combined, and the remaining dimples are conventional dimples. In one embodiment, the single-ring dimples may form triangular regions and have a double-ring or conventional dimple in the center or the double-ring dimples may form triangular regions and have a single-ring or conventional dimple in the center. In yet another embodiment, all of the dimples are single and double-ring.

Figure 6:
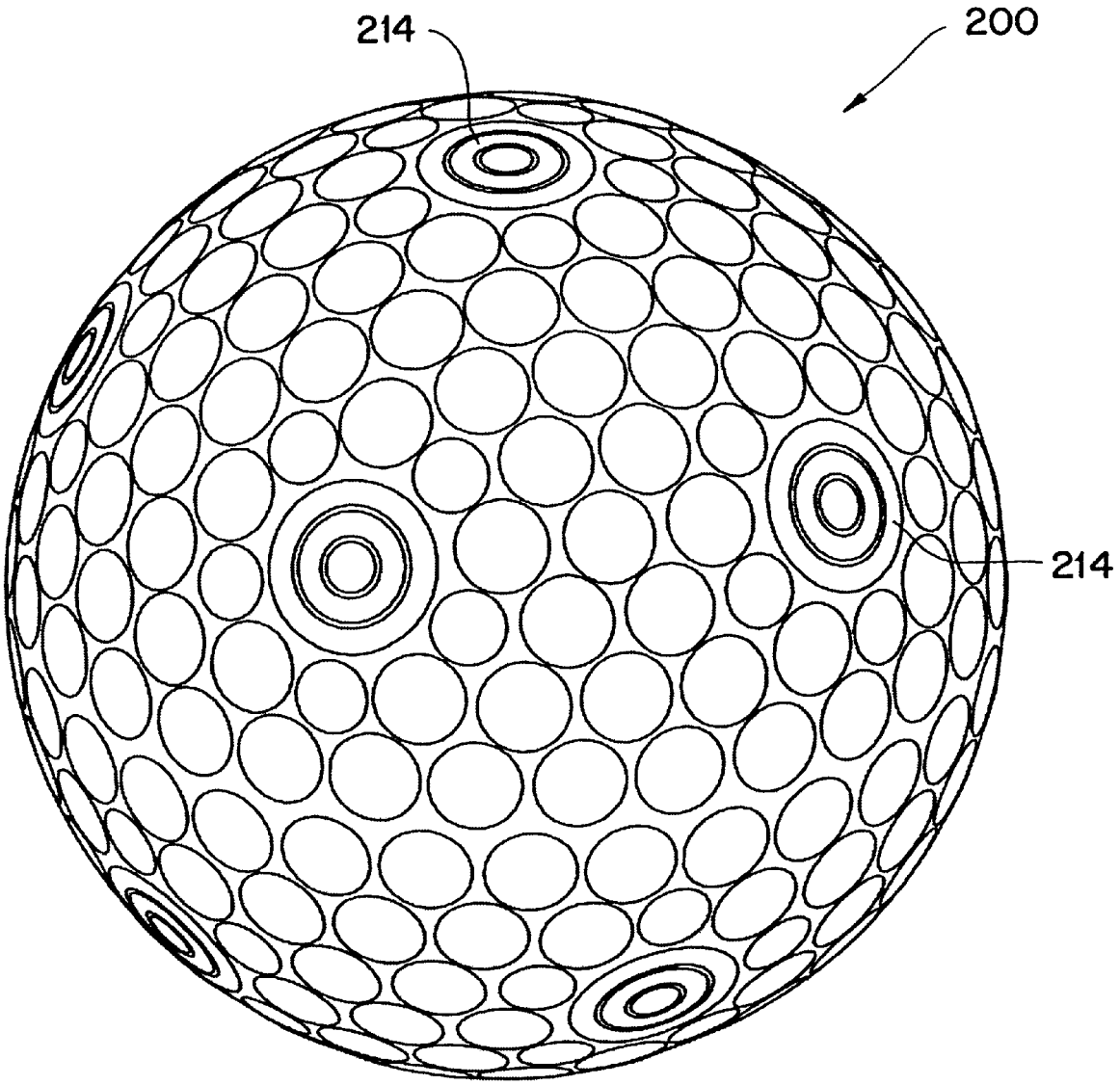
FIG. 6 is a perspective view of a fourth embodiment of a golf ball having dimples according to the present invention.

As shown in FIG. 6, a golf ball 200 according to the present invention has a plurality of dimples in an icosahedron pattern. In the icosahedron pattern, there are twenty triangular regions that are generally formed from the dimples. The icosahedron pattern has five triangles formed at both the top and bottom of the ball. Each of the five triangles shares the pole dimple as a point. There are also ten triangles that extend around the middle of the ball.

In this embodiment, the double-ring dimples 214 form the vertices of the icosahedron, where they replace groupings of small conventional dimples. There are 332 conventional dimples in this pattern and 12 double-ring dimples. The diameter of the double-ring dimples is about 0.300 inches.

Figure 7:
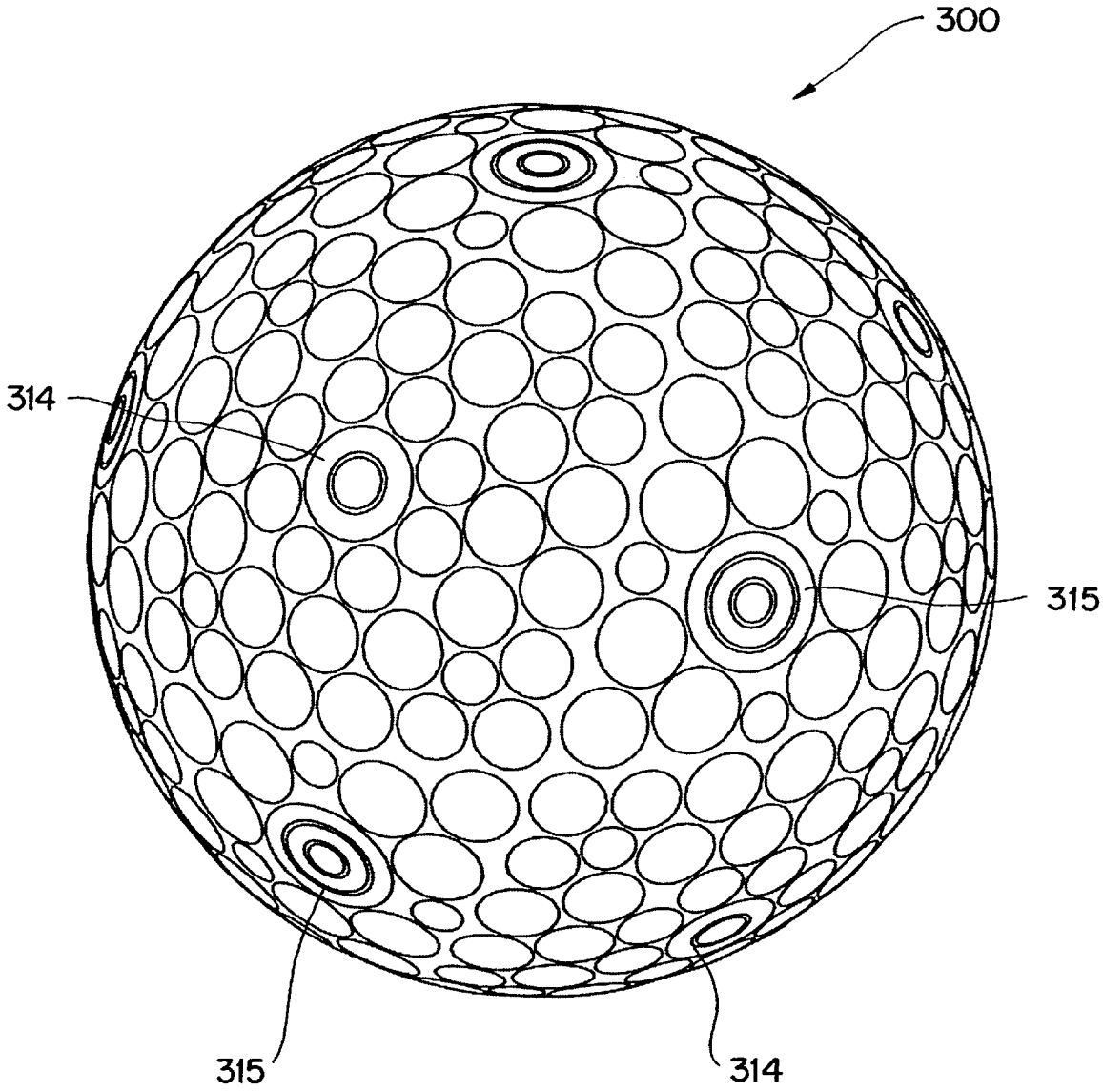
FIG. 7 is a perspective view of a fifth embodiment of a golf ball having dimples according to the present invention.

Referring to FIG. 7, a golf ball 300 according to the present invention has a plurality of dimples in a cuboctahedron pattern. In the cuboctahedron pattern, there are eight triangular regions and six square regions that are generally formed from the dimples.

There are six single-ring dimples 314 that are located at the center of each square region. These dimples replace groups of small dimples. There are nine double-ring dimples 315 located at the center of each triangular region that replace groups of small conventional dimples. There are 374 dimples in the pattern. The diameter of the single-ring dimples 314 is about 0.220 inches. The diameter of the double-ring dimples 314 is about 0.270 inches.

The advantage of the present invention is that the concentric ring dimples typically occupy the same space as three adjacent small conventional dimples or one large conventional dimple, but the concentric ring dimples provide additional dimple circumference. Thus, the concentric ring dimples improve the aerodynamic performance of the golf ball.

Dimple circumference for a single, conventional dimple 16*a* (as shown in FIG. 1) is calculated using the following equation:

$$\text{Dimple Circumference} = \pi d \qquad (1)$$

In order to calculate the total dimple circumference of the single-ring dimple 14 (as shown in FIGS. 1 and 2), the equation (1) is used to calculate circumference values for the central depression 18, the inner diameter of the annular depression 20, and the outer diameter of the annular depression 20. The sum of these values equals the total dimple circumference.

In order to calculate the total dimple circumference of the double-ring dimple 114 (as shown in FIG. 4), the equation (1) is used to calculate circumference values for the central depression 118, the inner diameter of the first annular depression 120, the outer diameter of the first annular depression 120, the inner diameter of the second annular depression 124, and the outer diameter of the second annular depression 124. The sum of these values equals the total dimple circumference.

Referring to Table I, the total dimple circumference is compared for dimples according to Examples 1–4. The dimple of Example 1 is a single, large, conventional dimple with a diameter of 0.290 inches. The dimples of Example 2 are a group of three conventional adjacent dimples with a diameter of 0.150 inches. The dimple of Example 3 is a single-ring dimple 14 (as shown in FIGS. 1 and 2) with a diameter of 0.290 inches. The dimple of Example 4 is a double-ring dimple 114 (as shown in FIGS. 3 and 4) with a diameter of 0.290 inches. The dimples in each example would all occupy about the same amount of space on the surface of a golf ball.

The single-ring dimple of Example 3 in comparison to the large conventional dimple of Example 1 or the group of the conventional smaller dimples of Example 2 has more total dimple circumference than either of the conventional dimples examples. This inventive single-ring dimple has twice the total dimple circumference of the large dimple of Example 1, and nearly one-third more total dimple circumference as the group of dimples of Example 2. Thus, the inventive single-ring dimple increases the aerodynamic effectiveness and performance that are achieved by a golf ball.

The double-ring dimple of Example 4 in comparison to the large, conventional dimple of Example 1 or the group of conventional dimples of Example 2 has more total dimple circumference than either of the conventional dimple examples. This inventive double-ring dimple has approximately three times the total dimple circumference as the large dimple of Example 1, and approximately twice as much total dimple circumference as the group of dimples of Example 2. Thus, the inventive double-ring dimple increases the aerodynamic effectiveness and performance that are achieved by a golf ball.

TABLE I

Total Dimple Circumference Comparison

| | Example 1 Large Conventional Dimple | Example 2 Group of Small Conventional Dimples | Example 3 Single-Ring Dimple | Example 4 Double-Ring Dimple |
|---|---|---|---|---|
| Total Dimple Circumference (inches) | 0.911 | 1.414 | 1.822 | 2.733 |

An additional advantage of the present invention is that the inventive dimples may improve putting performance. A large conventional dimple has less edge area on the ball surface. If the putter face contacts a dimple in any way other than squarely, it will cause the ball to rebound at an angle, which decreases putting accuracy. This effect is greater for larger dimples. The inventive dimple introduces additional land area within the dimple that minimizes this effect, and may lead to more accurate putting performance.

While it is apparent that the illustrative embodiments of the invention disclosed herein fulfill the objectives stated above, it is appreciated that numerous modifications and other embodiments may be devised by those skilled in the art. Although the cross-sectional shape of the dimples is described as circular, any conventional dimple shape may be used, for example elliptical or polygonal. Although the land rings are flat or shaped to match the outer surface of the golf ball, a beveled or "feathered" land ring may also be used. However, the wider land rings are preferable because they are more durable than the other shapes. Furthermore, if the amount of total dimple circumference is not sufficient, then additional circumference is created by adding additional concentric annular depressions to the dimples described above. Therefore, it will be understood that the appended claims are intended to cover all such modifications and embodiments which would come within the spirit and scope of the present invention.

What is claimed is:

1. A golf ball comprising:

a) a substantially spherical outer surface; and b) a plurality of dimples formed on the outer surface, at least three of a first type of dimple including i. a central depression having a central depression diameter;

ii. an annular depression concentrically surrounding the central depression and having an annular depression width; and iii. a land ring extending between the central depression and the annular depression, the land ring making Up a portion of the outer surface and having a land ring width;

wherein the land ring width is substantially less than the annular depression width.

2. The golf ball of claim 1, wherein the first type of dimple has an annular depression outer diameter of about 0.3 inches.

3. The golf ball of claim 1, wherein the central depression diameter is about 0.140 inches, the annular depression width is about 0.070 inches, and the land ring width is about 0.005 inches.

4. A golf ball comprising:

a) a substantially spherical outer surface; and b) a plurality of dimples formed on the outer surface, at least three of a first type of dimple including i. a central, single depression having a central depression diameter;

ii. at least two annular depressions concentrically surrounding the central depression and having annular depression widths; and iii. a plurality of land rings, one land ring making up a portion of the outer surface and extending between said central depression and said adjacent annular depression, other land rings making up a portion of the outer surface and extending between each of said adjacent annular depressions, and each land ring having a land ring width.

5. The golf ball of claim 1 or 4, wherein all of said dimples are said first type of dimple.

6. The golf ball of claim 1 or 4, wherein each of the land ring widths is less than about 0.010 inches.

7. The golf ball of claim 6, wherein each of the land ring widths is less than about 12% of the annular depression width.

8. The golf ball of claim 1 or 4, wherein each of the annular depression widths is about 50% of the central depression diameter.

9. The golf ball of claim 4, wherein the land ring widths are substantially less than the annular depression widths.

10. The golf ball of claim 4, wherein the central depression diameter is about 0.09 inches, the annular depression widths are between about 0.04 inches and about 0.05 inches, and the land ring widths are about 0.005 inches.

11. The golf ball of claim 4, further comprising at least one third type of dimple including a) a central depression;

b) an annular depression concentrically surrounding the central depression; and c) a land ring making up a portion of the outer surface and extending between the central depression and the annular depression.

12. The golf ball of claim 11, wherein between about 3% to about 50% of the dimples are said first type of dimple and said third type of dimple combined.

13. The golf ball of claim 11, wherein less than about 25% of the dimples are said first type of dimple and said third type of dimple combined.

14. A golf ball comprising:

a) a substantially spherical outer surface; and b) a plurality of dimples formed on the outer surface, at least three of a first type of dimple including i. a central depression having a central depression depth;

ii. at least one annular depression concentrically surrounding the central depression and having an annular depression depth and an annular depression width; and iii. a plurality of land rings, one land ring making up a portion of the outer surface and extending between said central depression and said adjacent annullar depression, and land rings making up a portion of the outer surface and extending between each of said adjacent annular depressions;

wherein the central depression depth is greater than or equal to the annular depression depth and the land ring width is substantially less than the annular depression width.

15. A golf ball comprising:

a) a substantially spherical, outer surface; and b) a plurality of dimples formed on the outer surface, at least three of a first type of dimple including i. a central depression having a central depression edge angle;

ii. at least one annular depression concentrically surrounding the central depression and having an inner annular depression edge angle and an outer annular depression edge angle; and iii. a plurality of land rings, one land ring making up a portion of the outer surface and extending between said central depression and said adjacent annular depression, and other land rings making up a portion of the outer surface and extending between each of said adjacent annular depressions;

wherein the central depression edge angle and the annular depression edge angles are approximately equal and the land ring width is substantially less than the annular depression width.

16. The golf ball of claim 15, wherein the central depression edge angle and the annular depression edge angles are between about 10° and about 25°.

17. The golf ball of claim 16, wherein the central depression edge angle and the annular depression edge angles are about 16°.

18. The golf ball of claim 17, wherein the central depression edge angle is uniform about the circumference of the central depression, and the annular depression edge angles are uniform about the circumference of the annular depression.

19. The golf ball of claim 1, 4, 11, 14, or 15, wherein at least one second type of dimple formed on the outer surface is a circular depression.

20. The golf ball of claim 19, wherein between about 3% and about 50% of the dimples are said first type of dimple.

21. The golf ball of claim 19, wherein less than about 25% of the dimples are said first type of dimple.

22. The golf ball of claim 19, wherein said second type of dimple forms a plurality of triangular regions on the outer surface.

23. The golf ball of claim 22, wherein said first type of dimple is located in the center of at least one of said triangular regions.

24. The golf ball of claim 1, wherein each annular depression is separate from the other annular depressions.

* * * * *